US006736689B2

(12) United States Patent
Renard et al.

(10) Patent No.: US 6,736,689 B2
(45) Date of Patent: May 18, 2004

(54) SUBASSEMBLY DESIGNED TO PRODUCE AN AQUATIC GLIDING BOARD

(75) Inventors: Philippe Renard, Moucy (FR); Eric Metrot, Bicton (AU)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/089,151

(22) PCT Filed: Jul. 26, 2001

(86) PCT No.: PCT/FR01/02463

§ 371 (c)(1),
(2), (4) Date: Apr. 19, 2002

(87) PCT Pub. No.: WO02/10011

PCT Pub. Date: Feb. 7, 2002

(65) Prior Publication Data

US 2002/0151233 A1 Oct. 17, 2002

(30) Foreign Application Priority Data

Jul. 28, 2000 (FR) ..... 00 10775

(51) Int. Cl.[7] ..... B63B 35/79
(52) U.S. Cl. ..... 441/65; 114/39.14; 441/74
(58) Field of Search ..... 114/39.14, 357; 441/65, 74

(56) References Cited

U.S. PATENT DOCUMENTS 3,429,758 A * 2/1969 Young ..... 156/79
3,514,798 A * 6/1970 Ellis ..... 441/74
3,839,080 A 10/1974 Jarema et al. ..... 117/132 B
4,118,814 A * 10/1978 Holtom ..... 114/357
4,964,825 A 10/1990 Paccoret et al. ..... 441/74
6,489,228 B1 * 12/2002 Vigna et al. ..... 441/74
6,561,118 B2 5/2003 Mead
6,623,323 B1 * 9/2003 Mead ..... 441/74

FOREIGN PATENT DOCUMENTS

| | | |
|---|---|---|
| DE | 2829380 | 1/1980 |
| DE | 2935529 | 3/1981 |
| DE | 4306671 | 9/1994 |

OTHER PUBLICATIONS

U.S. patent application No. 10/321,391 (Metrot), filed on Dec. 18, 2002.

U.S. patent application No. 10,321,392 (Metrot), filed on Dec. 18, 2002.

* cited by examiner

*Primary Examiner*—Sherman Basinger
(74) *Attorney, Agent, or Firm*—Greenblum & Bernstein, P.L.C.

(57) ABSTRACT

A structural subassembly provided to produce an aquatic gliding board. The subassembly includes a hollow inner shell which is covered with a casing made of foam capable of being machined. The invention also relates to a method of making such a subassembly and to a board made by covering the preceding subassembly with a layer of resin-coated fibers.

34 Claims, 6 Drawing Sheets

FIG.10
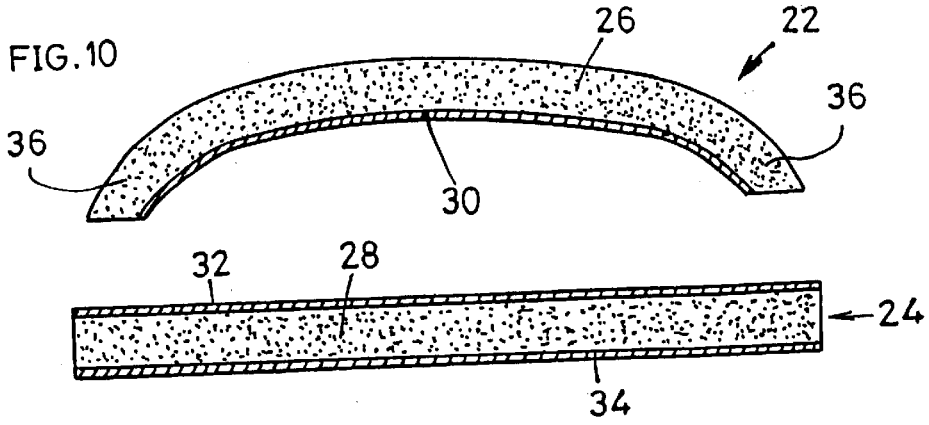
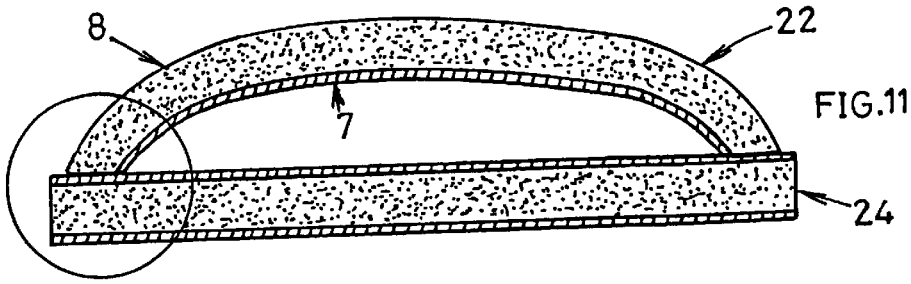
FIG.11
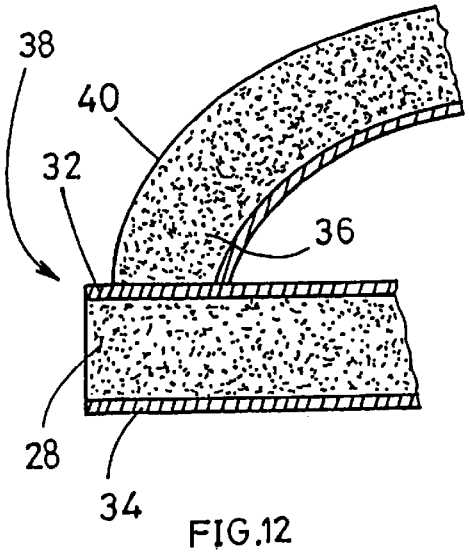
FIG.12
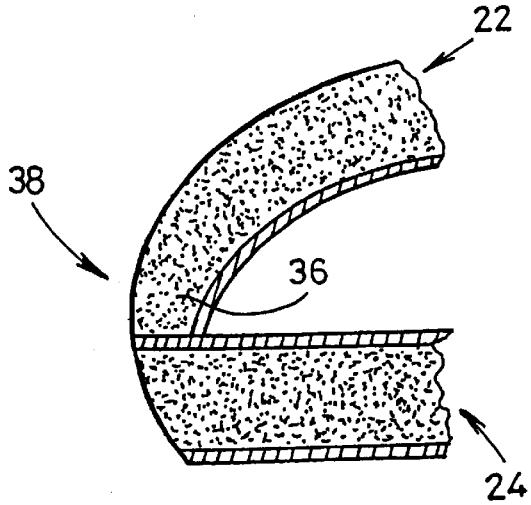
FIG.13

SUBASSEMBLY DESIGNED TO PRODUCE AN AQUATIC GLIDING BOARD

BACKGROUND OF THE INVENTION

1. Field of the Invention

The invention relates to a subassembly which is used in the production of an aquatic gliding board, especially a surfboard.

The invention also relates to a method for manufacturing such a subassembly and to a board manufactured using the subassembly.

2. Description of Background and Relevant Information

Conventionally, a surfboard is made from a foam blank, especially polyurethane foam blank, that is made in a mold. The foam blank is machined by planing and sanding over a small thickness to locally customize its shape, then it is covered with a casing made of resin-impregnated glass fibers that forms a reinforcing outer shell and provides the board with its final shape. A decoration and a glassing provide the board with its final appearance.

In certain cases, the foam blank is cut longitudinally into two portions that are then glued to a wooden stringer that reinforces its structure and imparts a predetermined longitudinal camber thereon.

The disadvantage of such a construction technique is the weight of the final board. Indeed, the foam is relatively thick; typically, its density is about 50 kg/m$^3$. In addition, it is a priori not possible to reduce the density of the foam without negatively affecting the mechanical properties of the board.

According to another construction technique derived from the sailboard, one begins with a relatively low density foam blank that is machined to shape. This blank is covered with a layer of resin-impregnated glass fibers. A casing made of a higher density foam is attached around this subassembly. Layers of resin-impregnated glass fibers are then applied in order to form the outer shell.

Such a construction mode enables a savings in weight of about 20% or more while maintaining a good rigidity beneath the feet. However, its implementation is relatively complex. Moreover, the central foam blank is generally made of polystyrene foam. This material has the flaw of taking in water. Over the course of its lifetime, the board sometimes hits a reef or a rock. If the outer shell is damaged, there is a risk of water penetration, the water weighing down the board and being particularly difficult to evacuate.

Finally, it is known to make hollow boards with sandwich layers. Alternatively, two half-shells are made and then assembled to one another, or yet the assembly is made in a closed mold with an inner bladder that is inflated to push and press the sandwich layers against the walls of the mold.

This manufacturing technique makes it possible to make lightweight boards. However, it is not possible to customize the shape of the board. In this case, the shape of the outer shell depends exclusively upon the shape of the mold.

SUMMARY OF THE INVENTION

An object of the invention is to propose an improved subassembly, which makes it possible to make surfboards that are lighter while preserving a shape that can be customized, or more voluminous for an equal weight.

This object is achieved by a structural subassembly which, according to the invention, includes a hollow inner shell covered with a casing made of foam capable of being machined.

The board is characterized in that it includes the predefined assembly coated with at least one layer of resin-impregnated fibers.

BRIEF DESCRIPTION OF DRAWINGS

The invention will be better understood from the description that follows, with reference to the annexed drawings, in which:

FIGS. 10–13 show transverse cross-sectional views of a fourth alternative embodiment of the invention in which the structural subassembly is made in the form of two half-shells.

DETAILED DESCRIPTION OF THE INVENTION

Figure 1:
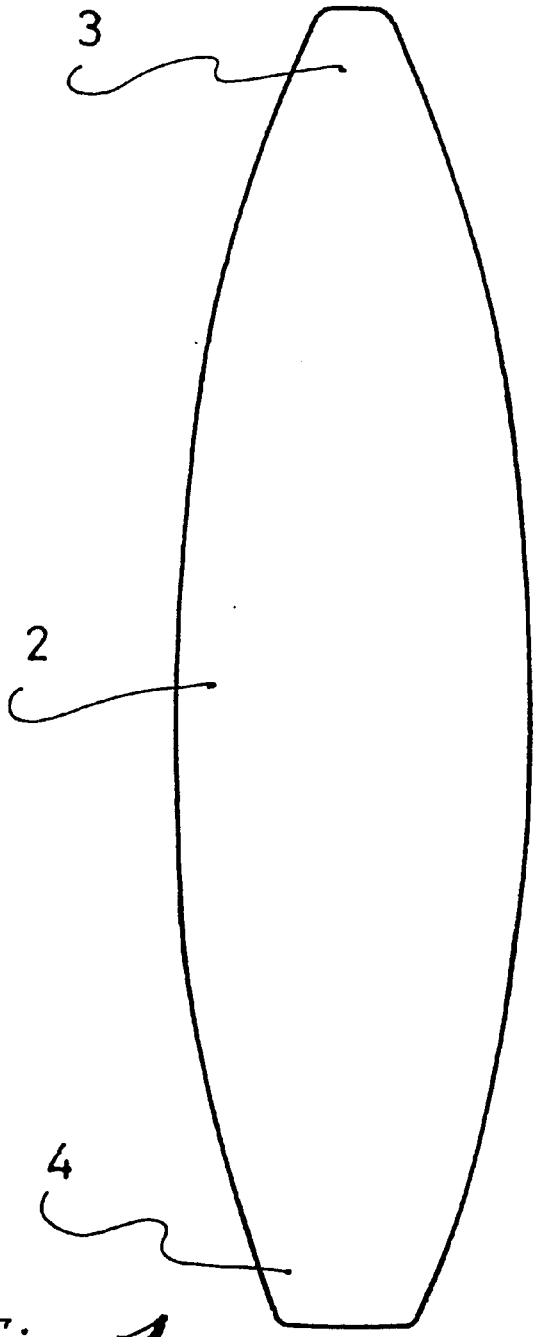
FIG. 1 is a top view of a surfboard.
Figure 2:
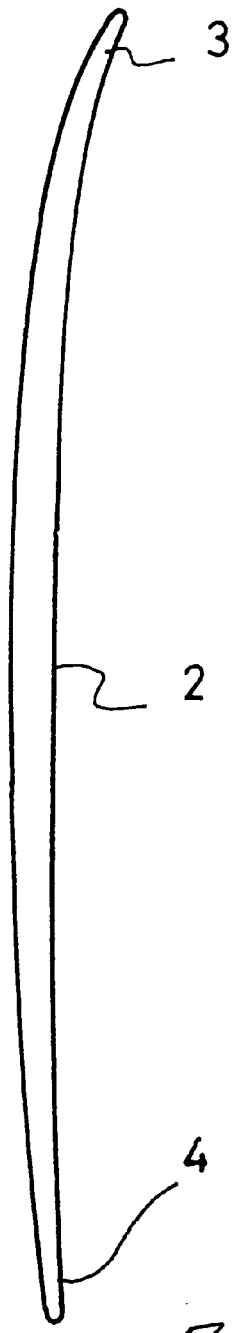
FIG. 2 is a side view of the board of FIG. 1.

With reference to FIGS. 1 and 2, a surfboard, in a known fashion, is in the form of an elongated board with a central portion 2, a tapered and slightly turned up front shovel 3, and a slightly turned up tail 4 and with a reduced width.

Figure 3:
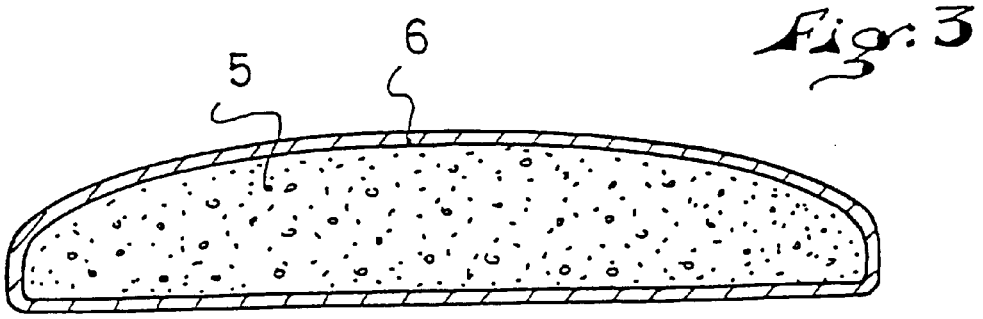
Fig: 3 PRIOR ART
FIG. 3 is a transverse cross-sectional view of a board made according to the prior art.

Conventionally, as shown in FIG. 3, the board is made of a foam blank 5, typically a polyurethane foam with a density of 50 kg/m$^3$, which is coated with a layer 6 of resin-coated fibers. Usually, the foam blank is made in a mold, and it is available in various models of variable length, width, volume and camber. Once selected by the shaper, the foam blank is provided with the desired final shape by local planing over a small thickness and, only thereafter, it receives its outer covering. This covering makes it possible to increase the mechanical features of the foam, and to protect the foam blank as well.

Figure 4:
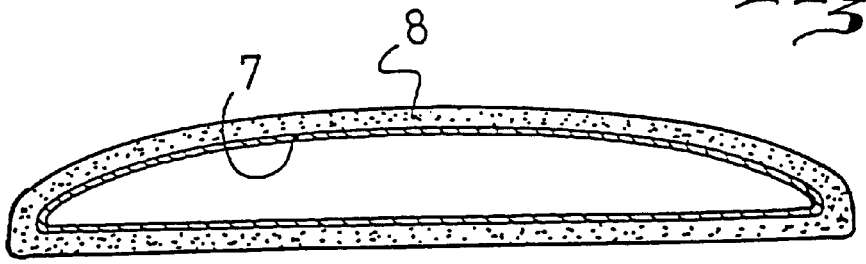
FIG. 4 shows a transverse cross-sectional view of the structural subassembly according to a first embodiment of the invention.
Figure 5:
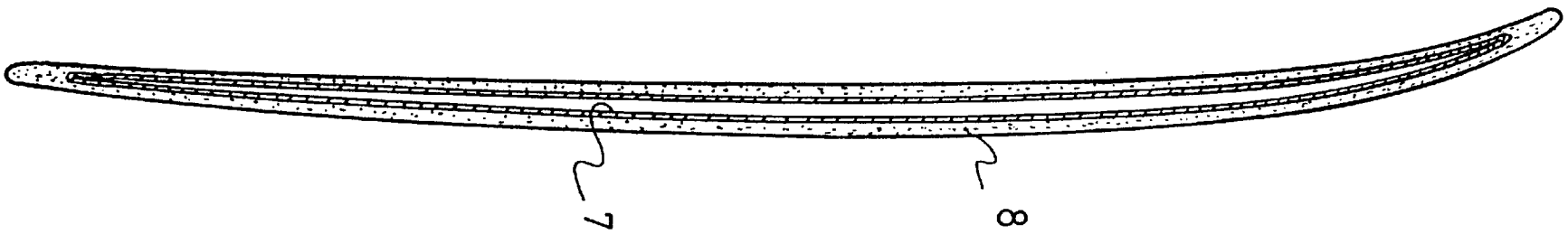
FIG. 5 is a longitudinal cross-sectional view of the board manufactured using the subassembly of FIG. 4.

FIGS. 4 and 5 show in a transverse cross-section and in a longitudinal cross-section, respectively, a structural subassembly of the board according to the invention, i.e., the subassembly that is located beneath the outer covering of the final board.

According to this first embodiment of the invention, the subassembly is formed by an inner shell 7 that is covered with a casing 8 made of foam. As shown in FIG. 4, for example, the outermost layer of the subassembly is the casing 8. This subassembly of inner shell and casing, without a final covering over the casing, can be regarded as a foam blank subassembly, or simply as a "blank", for the subsequent production of a gliding board.

The inner shell is hollow. This is a structural element made, for example, of glass fibers, carbon fibers or fibers of other synthetic material coated with resin, polyester resin, epoxy or the like.

For example, the inner shell is made with a thickness between 0.15 and 0.2 millimeters, or between 0.10 and 0.25 millimeters, or even more depending on the use intended for the board and the type of resin used. In certain cases, and depending on the material used, the thickness can reach 1–2 millimeters.

The inner shell can be manufactured according to various techniques. For example, it is formed around a central core made of polyester beads glued with vinyl glue, which is then dissolved in hot water. Other types of soluble mandrel or yet an inflatable bladder can be used.

According to another embodiment technique, the shell is manufactured by assembling a plurality of portions one to another. For example, the shell can be made from two half-shells which are nested into one another. The two portions are assembled by gluing or any other appropriate means. Still other possibilities exist.

The shell 7 can also be constructed with materials other than resin-impregnated fibers, for example a thermoplastic material, thermoplastic reinforced with fibers, fibers projected with a polyester matrix, stamped metal or any other material having a high elastic modulus.

The shell is covered with a casing 8. The casing is made of foam, but various types of foams can be used. For example, one can use a relatively dense PVC foam, with a density of 50–70 kg/m$^3$. One can also choose to use less dense foams, for example polyurethane foams of about 50 kg/m$^3$. One can also use (extruded or expanded) polystyrene foams of 30–50 kg/m$^3$ or yet polyether imide foams or any other waterproof foam.

The thickness of the casing is determined so as to enable a subsequent machining of this subassembly over this small thickness while having a final strong and lightweight subassembly. For example, the thickness is comprised between 3 and 15 millimeters, or even 20 millimeters. Possibly, one can provide a thickness that is greater along the lateral and front/rear edges of the subassembly, and smaller on the top and bottom. One can also provide different thicknesses on the top and bottom, front and rear.

To make the foam casing, foam sheets, or layers, are glued and curved to the shape of the shell by applying pressure, for example under vacuum by maintaining the interior of the shell at the atmospheric pressure so as not to deform this shell. An alternative is to place the shell at the center of a mold into which the foam is injected, or yet to cast or pulverize this foam on the shell and to allow it to expand in the open air. The polymerization of the foam ensures its superficial bonding with the shell. A primer can be applied to the surface of the shell to improve the performances.

The subassembly thus manufactured has the advantage of being lightweight and strong. Indeed, since the inner shell 7 is hollow, a significant savings in weight is achieved in relation to a conventional foam blank.

It is stronger than a conventional foam blank in view of its structure, with the inner shell and the relatively dense foam casing. The two elements cooperate complementarily, the shell, due to its own resistance and to the closed shell effect, and the foam, due to its own strength and the spreading effect of the constraints which it generates at the surface of the shell and the role of the core in the final sandwich after the addition of the last superficial layer.

In addition, due to the aforementioned savings in weight, one can select a stronger and more condensed foam than a conventional foam, while preserving a markedly lower weight than that of the conventional board.

Figure 4A:
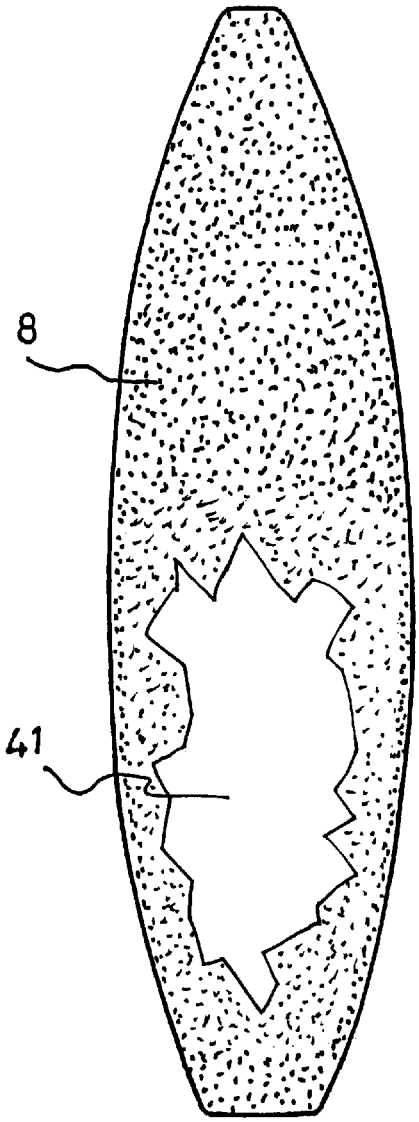
FIG. 4*a* shows a top view of the subassembly according to the first embodiment of the invention, with a schematically shown honeycomed structure for reinforcing the subassembly beneath the feet of the user, according to a variation.

Moreover, due to the thinness of the foam used and to the support of the shell, the surface 41 (shown as a schematic cutaway in FIG. 4*a*) beneath the feet can be reinforced by the addition of a honeycombed structure (plastic, cardboard, aluminum) at the time the foam is made.

Other filling materials, such as wood, or generally any material with a density of less than 1 can also be used.

The subassembly can be machined in the same manner as a conventional foam blank, depending on the shaper's preference, provided that the machining thickness remains less than the thickness of the foam.

As for the conventional blanks, the invention provides for the manufacture of a plurality of models of structural subassemblies with a variable length, width, thickness and camber. However, one can use a same model of shell for a plurality of models of boards, and can vary the form and thickness of the foam casing to have the desired final forms.

Figure 6:
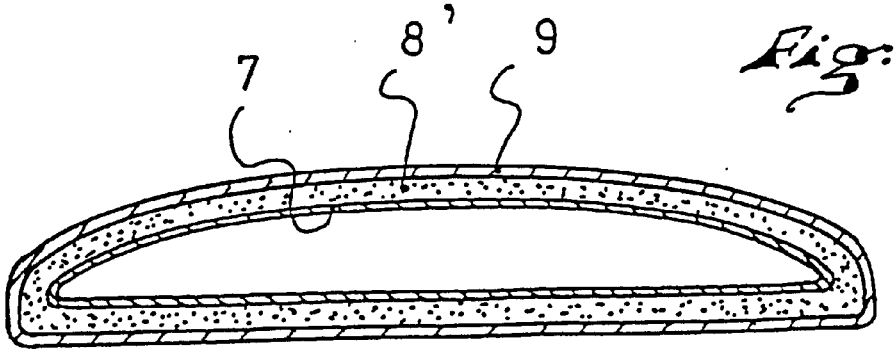
FIG. 6 shows the same board in a transverse cross-section.

Finally, once shaped, the structural subassembly with its shaped foam layer 8' is provided to be coated with a layer 9 made of resin-coated glass fibers or the like, and to receive the finishing operations in the same manner as a conventional board. This is shown in FIG. 6.

During use, given that the inner shell is hollow, a user would have less difficulty in evacuating the water, if necessary, which would have infiltrated following an impact due, in particular, to the incorporation of a drain plug. In this regard, one can provide inside the shell an inflated bladder that reduces the water penetration within the shell. This bladder can even be inflated with a lighter gas than air, for example helium, in order to lighten the structure even more.

Figure 7:
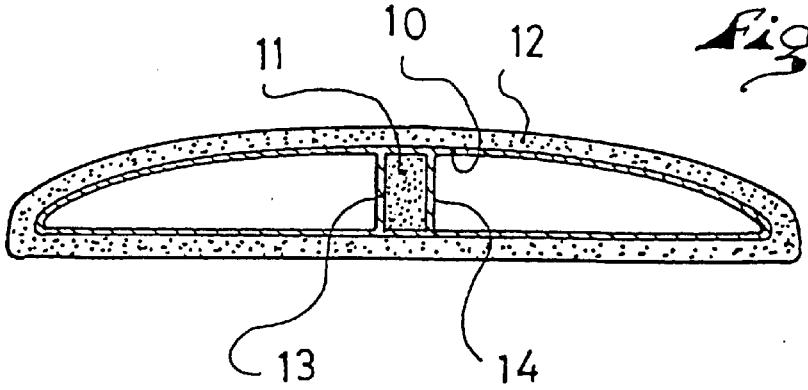
FIGS. 7, 8, and 9 are transverse cross-sectional views showing three alternative embodiments of the invention.

FIG. 7 relates to an alternative embodiment of the invention. According to this alternative, the inner shell 10 is reinforced by a central partition 11. Such a partition is commonly used, in particular for longboards, in order to provide them with a predetermined camber and a better longitudinal rigidity. Thus, although the embodiment of FIG. 7 can be regarded as including an inner shell 10 that is hollow, a partition is nevertheless provided, for the aforementioned reasons.

Figure 7A:
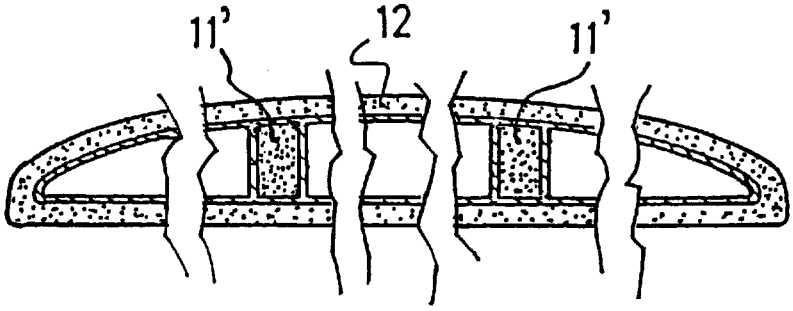
FIG. 7*a* shows a variation of the embodiment of FIG. 7, having a plurality of partitions within the shell of the subassembly.

In the present case, the central partition 11 is made of foam or wood, for example. It extends over the length of the shell. The shell 10 is formed around this partition. Possibly, the partition is edged with two layers 13 and 14 of resin-impregnated fibers, which are continuously connected to the wall of the shell. In the variation shown in FIG. 7*a*, a plurality of partitions 11' is provided.

As in the preceding case, the shell 10 is covered with a casing 12 made of foam.

Figure 8:
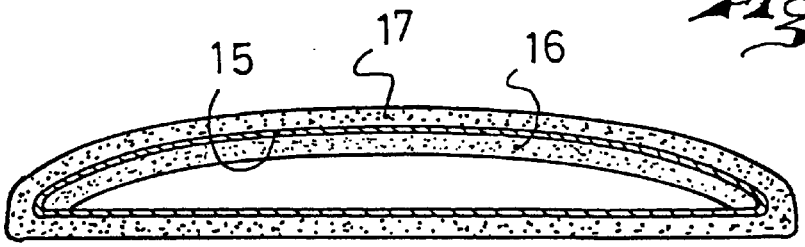

FIG. 8 relates to another alternative embodiment, where the upper wall of the shell 15 is supported by a previously curved foam sheet, or layer, 16.

To make the subassembly, for example, the layer 16 is shaped by thermoforming or any other appropriate technique.

Initially, the lower wall of the shell is made, on which the layer 16 is positioned.

Next, the manufacture of the shell is completed by covering the layer 16 with the layer of resin-impregnated fibers, the foam casing 17 is then formed.

This layer late 16 increases the resistance to depression in the upper portion of the subassembly, i.e., beneath the surfer's feet.

Figure 9:
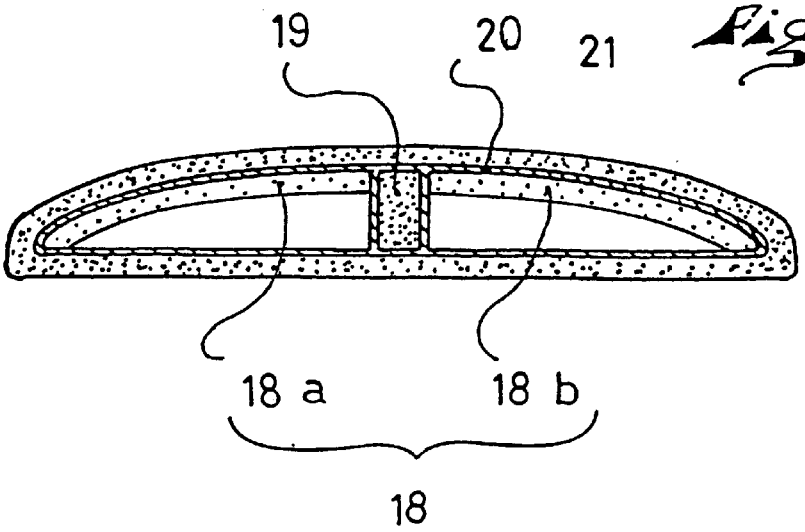

According to the alternative embodiment shown in FIG. 9, the layer 18 is made of two parts 18*a*, 18*b* that are joined in the area of a central partition 19 of the same type as the partition 11. As in the preceding case, the shell 20 is closed above the layer 18, and the envelope 21 is formed around the shell 20.

FIGS. 10–13 show another alternative embodiment of the invention in which the structural subassembly is made from two assembled half-shells. The subassembly can thus be formed of an upper half-shell 22, which will form the deck of the final board, and of a lower half-shell 24 which will form the hull. Each half-shell is formed of a foam sheet, or layer, 26, 28 that is first thermoformed in a mold, and then covered, over an inner surface 30, 32, with at least one layer of resin-impregnated fabric. Advantageously, the operation of laminating the inner surface 30, 32 of the half-shells 22, 24 is performed under vacuum, whereas the previously thermoformed foam sheet 26, 28 is still in the thermoforming mold, so that the layer of resin-coated fabric hardens on the thermoformed sheet while the latter is still pressed against the mold. The form of the half-shell is thus guaranteed at best before the assembly.

When the two half-shells 22, 24 are assembled to one another, for example by gluing, one directly gets the rigid inner shell 7, which is formed by the layers of resin-coated fabric arranged on the inner surfaces of the half-shells, on the one hand, and the outer foam casing 8 capable of being machined, on the other hand. The foams used are for example sheets of extruded polystyrene foam having a density on the order of 30–50 kg/m$^3$.

To implement this alternative embodiment, it can be advantageous to provide that one of the half-shells, for the example the lower half-shell 24, also be laminated on its outer surface 34 before the assembly of the two half-shells. The half-shell thus laminated on its two surfaces 32, 34 is then particularly rigid during assembly with the other half-shell, which makes it possible to better control the precision of the assembly, and therefore the precision of the form of the subassembly. Of course, the foam casing covering the shell is then no longer capable of being machined over its entire area. Indeed, since one of the surfaces is already laminated at the time of assembly, the geometry of this surface can no longer be substantially modified. However, it has been noted that to substantially modify the final behavior of the gliding board, it often suffices to modify the geometry of the lateral edges of the board (generally referred to as the rails of the board). However, this geometry can be modified even if one of the outer surfaces of the board (for example the lower surface) is already laminated.

In the example shown in FIGS. 10–13, one can see that the two half-shells are not symmetrical. Indeed, one can see that the lower half-shell 24 does not include any lateral side-walls. During the shaping, the sheet, or layer, is bent longitudinally (which is therefore not visible in the drawings) so as to follow the longitudinal cambering curve (sometimes called the rocker curve or scoop curve). It could also be bent transversely, for example to form a V-shaped or double concave hull, but in the example shown, the lower half-shell does not have any transverse curvature. In this case, given that the deformation of the foam layer in relation to its initial planar state is relatively minimal, the shaping of the layer can be done without thermoforming, simply by applying the layer against the mold by depression at the time of lamination. After the resin is cured, the rigidity of the resin-coated fabric suffices to maintain the layer in the shape desired for the half-shell.

Conversely, the upper half-shell 22 is thermoformed so as to be bent longitudinally, but also transversely to form downwardly curved lateral side-walls 36. According to the invention, the inner surfaces (i.e., the lower surface 30 of the upper half-shell 22 and the upper surface 32 of the lower half-shell 24) are laminated with one or several layers of thermosetting resin-impregnated fiber fabrics. As can be seen in FIG. 10, the lower surface 34 of the lower half-shell 24 is also laminated, before the assembly of the two half-shells.

As can be seen in FIG. 11, the assembly of the two half-shells is made by gluing the lower edge of the lateral side-walls 36 of the upper half-shell 22 against the upper surface 32 of the lower half-shell 24. The glue is selected so that it is not too difficult to machine, i.e., so that it does not create any hard spot in the constituent foam of the lateral side-wall of the subassembly.

With this construction, it is seen in FIG 12 (which shows in more detail the lateral edge of the subassembly right after the assembly) that the largest portion at the top of the lateral side-wall 38 of the structural assembly is formed by the lateral side-walls 36 of the upper half-shell whose outer surface 40 is made of foam. The lower portion of these lateral side-walls is constituted by the lateral edge of the lower half-shell which has a foam thickness 28 sandwiched (top and bottom) by two resin-impregnated fabric layers 32, 34. As the fabric layers 32, 34 are very thin, they do not impede the shaping of the lateral side-walls. Thus, one can see in FIG. 13 that the geometry of the lateral side-wall 38 of the structural subassembly has been modified over the entire height of the lateral side-wall 38, by machining, such as, for example by planing and sanding. Such removal of material, in the example of FIG. 13, as well as provided for in other embodiments of the invention, can result in the thickness of the outer casing to be non-uniform.

However, in an alternative embodiment (not shown), it can be provided that the peripheral portion of the upper surface 32 of the lower half-shell 24 not be laminated, so that the lateral side-walls 36 of the upper half-shell 22 are in support against the foam 28, in order to ensure a better continuity of the material forming the lateral side-wall 38, which then is only made of foam.

The lamination of the outer surface, in this case the lower surface 34 of the lower half-shell, can be integral (as illustrated). It can also only affect a portion of the surface, for example the central portion, to preserve a perfect machinability of the lateral edge 38.

With this construction, the precise assembly of the two half-shells is facilitated by the substantial rigidity of the lower half-shell, and the subassembly remains capable of being machined over its entire upper surface and on its lateral side-walls, which allows a great possibility to customize the subassembly. Once customized, the structural subassembly is covered with an outer layer of resin-impregnated fibers. As the case may be, one can choose to also cover the already laminated outer surface 34 of the subassembly with this outer layer so as to increase the rigidity and strength of the board, or conversely can choose not cover this already laminated surface 34 in order to limit the weight of the board.

Of course, in the case where one would prefer the possibility to customize the bottom of the board, it could be provided that the half-shell laminated on its two surfaces be the upper half-shell, the lower half-shell then only being laminated on its upper surface 32. In both cases, the subassembly thus made is a subassembly which, in the context of the invention, comprises a hollow and rigid inner shell, and a foam casing capable of being shaped which entirely covers this inner shell. Optionally, a portion of this casing (the geometry of which one does not wish to modify, for example the upper surface of the upper half-shell or the lower surface of the lower half-shell), can be covered with a rigid outer layer.

As in the case of the embodiments of FIGS. 7 and 9, one can provide advantageously the subassembly of FIGS. 10–13 with a longitudinal central partition that vertically connects the two half-shells.

Naturally, the present description is provided for guidance only, and other embodiments thereof can be adopted without leaving the scope of the present invention. For example, one can double the inner shell and therefore have a stacking alternately including layers of fibers and layers of foam for the subassembly. One can also have a plurality of longitudinal, transverse, or otherwise appropriately directed partitions, these partitions forming connections between the top and the bottom of the board. Possibly, these partitions can create a partitioning of the inner shell into a plurality of waterproof compartments.

moreover, the invention could be applied to the construction of boards other than surfboards, for example, boards for sailboards, boards adapted for swimming on waves and, generally, any aquatic activity in which the board operates mostly in the lift-off mode.

What is claimed is:

1. A blank for the subsequent production of an aquatic gliding board, said blank comprising:

a hollow inner shell;

a casing positioned over said inner shell, said casing comprising a foam capable of shaping by removal of material by planing and/or sanding, an outermost surface of the foam comprising an outermost surface of the blank.

2. A blank according to claim 1, wherein said inner shell includes a wall having a thickness of 0.1 to 2.0 millimeters.

3. A blank according to claim 1, wherein:

said inner shell comprises a resin-impregnated fiber layer.

4. A blank according to claim 1, further comprising:

a longitudinally extending partition within said inner shell for reinforcing said inner shell.

5. A blank according to claim 4, wherein:

said longitudinally extending partition is a central partition.

6. A blank according to claim 1, wherein:

said inner shell comprises an upper wall; and the blank further comprises a curved layer of foam positioned on said upper wall within said inner shell.

7. A blank according to claim 1, wherein:

said foam casing comprises a thermoformed extruded polystyrene foam.

8. A blank according to claim 1, further comprising:

a honeycombed reinforcement structure.

9. A blank according to claim 1, wherein:

said foam casing has a thickness between 3 and 20 millimeters.

10. A subassembly for later manufacture of an aquatic gliding board, said subassembly comprising:

a hollow inner shell;

a casing comprising a machinable thermoformed foam layer positioned over said inner shell, an outermost surface of said foam layer comprising an outermost surface of the subassembly.

11. A subassembly according to claim 10, further comprising:

at least one longitudinally extending reinforcing partition within said hollow inner shell.

12. A subassembly according to claim 10, further comprising:

a plurality of longitudinally extending reinforcing partitions within said hollow inner shell.

13. A subassembly for later manufacture of an aquatic gliding board, said subassembly comprising:

a hollow inner shell;

a casing covering said inner shell;

said casing comprising a thermoformed layer of extruded polystyrene foam;

an outermost surface of said layer of extruded polystyrene foam comprising an outermost surface of the subassembly.

14. A subassembly according to claim 13, further comprising:

at least one longitudinally extending reinforcing partition within said hollow inner shell.

15. A subassembly according to claim 13, further comprising:

a plurality of longitudinally extending reinforcing partitions within said hollow inner shell.

16. An aquatic gliding board comprising:

a foam blank subassembly comprising:

a hollow inner shell;

a casing made of a machinable foam positioned over said inner shell, an outermost surface of said machinable foam comprising an outermost surface of said foam blank subassembly, said casing having a non-uniform thickness from said foam of said casing having been machined; and an outer covering positioned over said machined casing.

17. An aquatic gliding board according to claim 16, wherein:

said outer covering comprises a layer of resin-coated fibers.

18. An aquatic gliding board according to claim 17, wherein:

said inner shell comprises a layer of resin-coated fibers.

19. An aquatic gliding board according to claim 16, wherein said inner shell includes a wall having a thickness of 0.1 to 2.0 millimeters.

20. An aquatic gliding board according to claim 19, wherein:

said foam casing has a thickness between 3 and 20 millimeters.

21. An aquatic gliding board according to claim 16, wherein:

said machinable foam of said casing comprises an extruded polystyrene foam.

22. An aquatic gliding board according to claim 16, wherein:

said machinable foam of said casing comprises at least one thermoformed layer of an extruded polystyrene foam.

23. An aquatic gliding board comprising:

a hollow inner shell;

an outer shell; and a casing between said inner shell and said outer shell, said casing comprising at least one layer of a thermoformed extruded polystyrene foam.

24. An aquatic gliding board according to claim 23, wherein:

said outer shell lies directly over said layer of thermoformed extruded polystyrene foam.

25. An aquatic gliding board according to claim 23, wherein:

said casing is at least part of an upper shell portion and a lower shell portion of the aquatic gliding board, said upper shell portion forming a deck of the aquatic gliding board and said lower shell portion forming a hull of the aquatic gliding board;

said at least one layer of a thermoformed extruded polystyrene foam comprising at least one layer of a thermoformed extruded polystyrene foam in said upper shell portion and at least one layer of a thermoformed extruded polystyrene foam in said lower shell portion.

26. An aquatic gliding board according to claim 25, further comprising:

at least one longitudinally extending reinforcing partition within said hollow inner shell.

27. An aquatic gliding board according to claim 25, further comprising:

a plurality of longitudinally extending reinforcing partitions within said hollow inner shell.

28. A method of manufacturing a subassembly for use in a subsequent production of an aquatic gliding board, said method comprising:

forming an upper half-shell comprising a machinable foam layer, said upper half-shell having a lower surface covered with an inner layer of thermosetting resin-impregnated fibers;

forming a lower half-shell comprising a machinable foam layer, said lower half-shell having an upper surface covered with an inner layer of thermosetting resin-impregnated fibers;

assembling said upper half-shell to said lower half-shell so that said inner layer of thermosetting resin-impregnated fibers of said upper half-shell and said inner layer of thermosetting resin-impregnated fibers of said lower half-shell form a hollow shell covered with a casing made of foam capable of being machined, an outermost surface of said foam layer of at least one of said upper and lower half-shells comprising an outermost surface of the subassembly.

29. A method according to claims 28, wherein, before said assembly of said upper half-shell to said lower half-shell, said method further comprises covering a portion of at least one of said upper and lower half-shells with an outer layer of thermosetting resin-impregnated fibers.

30. A method according to claim 29, wherein said covering of a portion of at least one of said upper and lower half-shells with an outer layer of thermosetting resin-impregnated fibers comprises covering a lower surface of said lower half-shell with a layer of thermosetting resin-impregnated fibers.

31. A method of manufacturing an aquatic gliding board comprising:

forming an upper half-shell comprising a foam layer, said upper half-shell having a lower surface covered with an inner layer of thermosetting resin-impregnated fibers;

forming a lower half-shell comprising a foam layer, said lower half-shell having an upper surface covered with an inner layer of thermosetting resin-impregnated fibers;

assembling said upper half-shell to said lower half-shell so that said inner layer of thermosetting resin-impregnated fibers of said upper half-shell and said inner layer of thermosetting resin-impregnated fibers of said lower half-shell form a foam blank subassembly comprising a hollow shell covered with a foam casing, whereby said foam layer of at least one of said upper and lower half-shells comprises an outermost layer of the subassembly;

removing material from said outermost layer of said subassembly; and applying an outer covering at least over said outermost layer of said subassembly.

32. An aquatic gliding board made according to the method of claim 31.

33. A method of manufacturing an aquatic gliding board comprising:

forming an upper half-shell comprising at least one layer of thermoformed extruded polystyrene, said upper half-shell having a lower surface covered with an inner layer of thermosetting resin-impregnated fibers;

forming a lower half-shell comprising at least one layer of thermoformed extruded polystyrene, said lower half-shell having an upper surface covered with an inner layer of thermosetting resin-impregnated fibers;

assembling said upper half-shell to said lower half-shell so that said inner layer of thermosetting resin-impregnated fibers of said upper half-shell and said inner layer of thermosetting resin-impregnated fibers of said lower half-shell form a foam blank subassembly comprising a hollow shell covered with a foam casing, whereby said at least one layer of thermoformed extruded polystyrene of at least one of said upper and lower half-shells comprises an outermost layer of said subassembly; and applying an outer covering at least over said outermost layer of said subassembly.

34. An aquatic gliding board made according to the method of claim 33.

* * * * *